US008132271B2

(12) United States Patent
Chiang

(10) Patent No.: US 8,132,271 B2
(45) Date of Patent: Mar. 13, 2012

(54) SWIMMING GOGGLES

(76) Inventor: Herman Chiang, Chung-Ho (TW)

( * ) Notice: Subject to any disclaimer, the term of this patent is extended or adjusted under 35 U.S.C. 154(b) by 316 days.

(21) Appl. No.: 12/458,483

(22) Filed: Jul. 14, 2009

(65) Prior Publication Data

US 2010/0319112 A1 Dec. 23, 2010

(30) Foreign Application Priority Data

Jun. 23, 2009 (TW) ..... 98211294 U

(51) Int. Cl.
*A61F 9/02* (2006.01)

(52) U.S. Cl. ..... 2/444

(58) Field of Classification Search ..... 2/444–446
See application file for complete search history.

(56) References Cited

U.S. PATENT DOCUMENTS 6,289,523 B1 * 9/2001 Chiang ..... 2/428
7,007,310 B2 * 3/2006 Chiang ..... 2/446
7,698,751 B2 * 4/2010 Chiang ..... 2/450
2005/0268386 A1 * 12/2005 Oishi et al. ..... 2/448
2009/0038060 A1 * 2/2009 Chiang ..... 2/440

* cited by examiner

*Primary Examiner* — Katherine Moran
(74) *Attorney, Agent, or Firm* — Cheng-Ju Chiang

(57) ABSTRACT

Swimming goggles are provided which include a hard combined frame, a soft left frame and a soft right frame receiving lenses therein, and hard buckles. The hard combined frame includes a first assembling frame, a second assembling frame, and a connecting member connecting the first assembling frame with the second assembling frame. The soft left frame and the soft right frame are respectively assembled on the first assembling frame and the second assembling frame. The hard buckles are respectively assembled on the first assembling frame and the second assembling frame for accommodating a head strap. The connecting member has first portions with bendable flexibility for fitting to users' nose profiles. The first assembling frame and the second assembling frame have second portions with bendable flexibility on parts of side edges thereof for fitting to users' face profiles.

10 Claims, 6 Drawing Sheets

SWIMMING GOGGLES

BACKGROUND OF THE INVENTION

1. Field of the Invention

The present invention relates to swimming goggles, and particularly to swimming goggles which is ergonomical and suits for users with different face and nose profiles without leakage of water.

2. Related Art

Swimming goggles are generally categorized as two types: separate type and integral type. The separate type has a separate connecting member connecting a left frame and a right frame together; while the integral type has a left frame and a right frame integrally formed with a connecting member. The connecting member of the separate type is made of rigid material, and fails to have flexibility to fit for various users with different nose profiles, especially for those with high nose bridges. In addition, lack of flexibility increases risk of water leakage arising from unclosed touch of the left and the right frames to a user's face.

The integral type of swimming goggles have a left frame and a right frame integrally formed with a connecting part. The instant invention is involved of the separate type of swimming goggles. The connecting member of the separate type is ordinarily made of hard material, and therefore, is not flexible when being worn. Accordingly, such swimming goggles cannot suit for users with different nose profiles, and are even rather uncomfortable for the users with Roman nose. Due to lack of flexibility, the left frame and the right frame can not fit to each other closely, taking risk of leakage.

SUMMARY OF THE INVENTION

Accordingly, an object of the present invention is to provide swimming goggles which meet users with different face and nose profiles, and which are ergonomic and prevent from water leakage, wherein the swimming goggles are bendable on parts corresponding to users' nose bridges and temples for fitting for users' nose profiles and face profiles.

The swimming goggles comprise a hard combined frame, a soft left frame, a soft right frame and hard buckles. The hard combined frame includes a first assembling frame, a second assembling frame, and a connecting member connecting the first assembling frame with the second assembling frame. The first assembling frame defines a first opening, and the second assembling frame defines a second opening. The soft left frame and the soft right frame are respectively assembled in the first opening and the second opening. The soft left frame and the soft right frame respectively receive lenses therein and are formed with pads. The hard buckles are respectively assembled on the first assembling frame and the second assembling frame for accommodating a head strap. The connecting member has first means with bendable flexibility for fitting to users' nose profiles. The first assembling frame and the second assembling frame have second means with bendable flexibility for fitting to users' face profiles. The users with different nose and face profiles wear the swimming goggles ergonomically and comfortably without water leakage.

DESCRIPTION OF THE PREFERRED EMBODIMENTS

Figure 1:
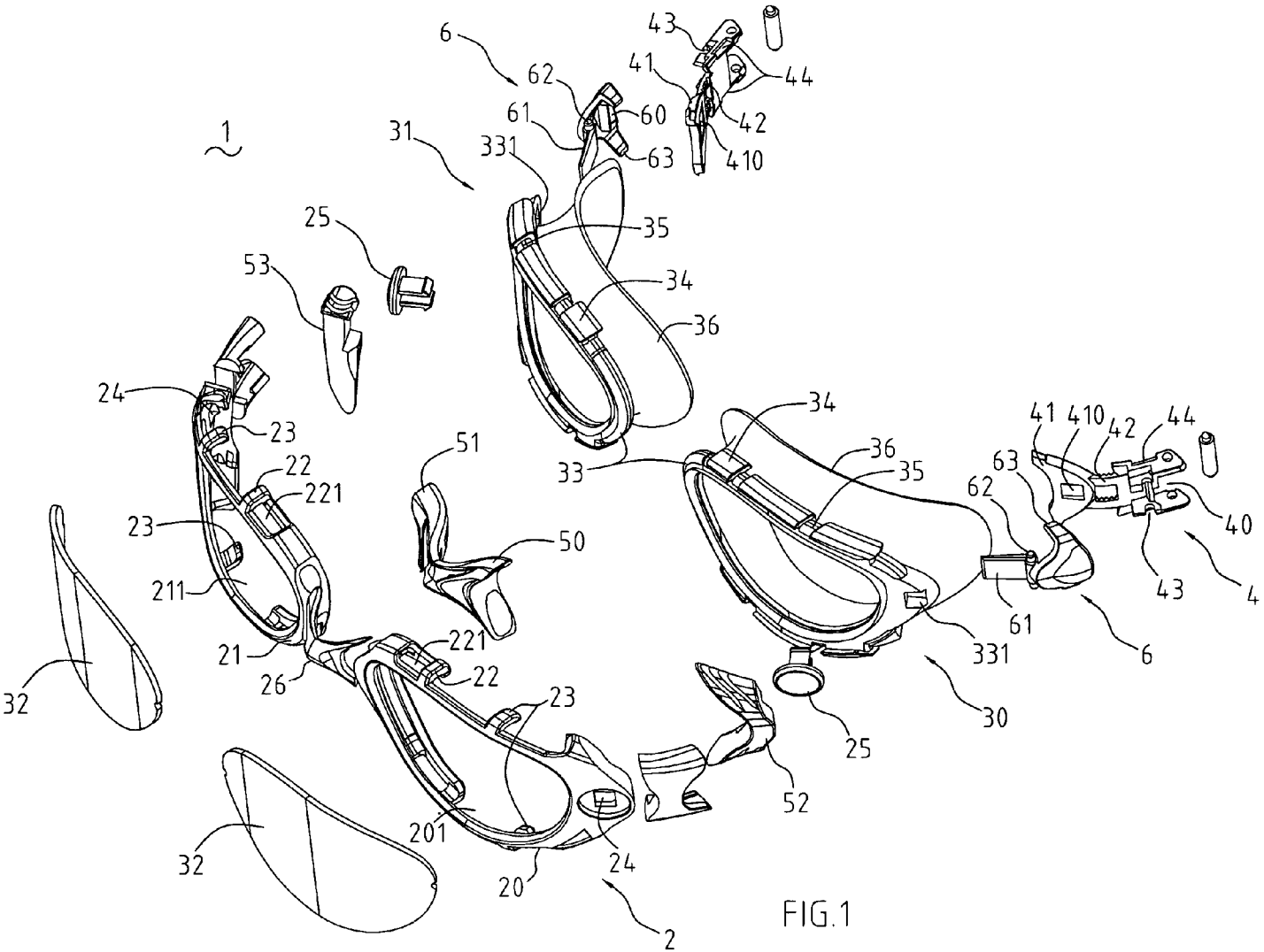
FIG. 1 is an exploded view of swimming goggles according to the present invention.
Figure 2:
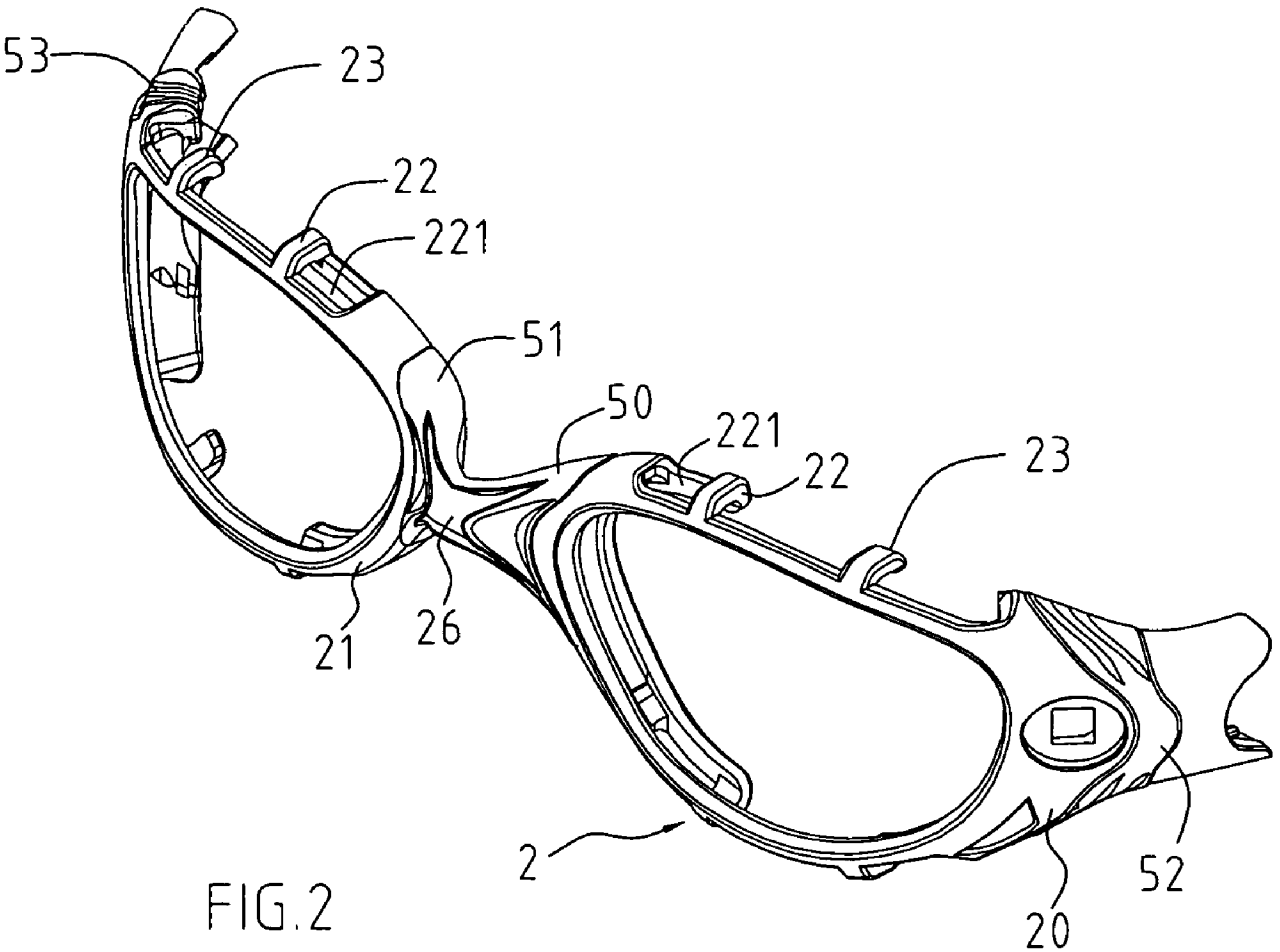
FIG. 2 is a partial, assembled view of the swimming goggles of FIG. 1.

Referring to FIG. 1, swimming goggles 1 in accordance with the present invention comprise a hard combined frame 2, a soft left frame 30, a soft right frame 31, hard buckles 4 and strap adjusting elements 6. The hard combined frame 2 is made of Polypropylene (PP), and includes a first assembling frame 20, a second assembling frame 21, and a connecting member 26 connecting the first assembling frame 20 with the second assembling frame 21. The first assembling frame 20 defines a first opening 201 for receiving the soft left frame 30, and the second assembling frame 21 define a second opening 211 for receiving the soft right frame 31. The first assembling frame 20 and the second assembling frame 21 respectively form arcuate clamp portions 22 near the connecting member 26. The clamp portions 22 are near the connecting member 26 in assembly and respectively define positioning holes 221 therein. Clamp arms 23 are respectively formed on the first assembling frame 20 and the second assembling frame 21 and adjacent to the clamp portions 22. Assembling holes 24 and expanding screws 25 are respectively formed in the first assembling frame 20 and the second assembling frame 21 and correspond to sides of the connecting member 26. The first assembling frame 20 and the second assembling frame 21 are respectively assembled onto the soft left frame 30 and the soft right frame 31 by the clamp portions 22, clamp arms 23 and assembling holes 24. The connecting member 26 forms a first joint portion 50 and a second joint portion 51 on both sides thereof. The first joint portion 50 and the second joint portion 51 are made of soft material, for example, Thermoplastic Rubber (TPR) which is featured of injection shaping and gluing. In this way the connecting member 26 is of flexibility of bending when the swimming goggles are worn. Further referring to FIG. 2, the first assembling frame 20 and the second assembling frame 21 respectively form a third joint portion 52 and a fourth joint portion 53 on parts of sides edges thereof. The third joint portion 52 and the fourth joint portion 53 are also made of soft material, such as Thermoplastic Rubber (TPR) which is featured of injection shaping and gluing. The third joint portion 52 and the fourth joint portion 53 provide partial bendable flexibility for fitting to users' faces closely.

The soft left frame 30 and the soft right frame 31 are made of Silicon Rubber. Lenses 32 are received on the soft left frame 30 and the soft right frame 31. The soft left frame 30 and the soft right frame 31 are formed with pads 36. Flanges 3 are formed on the soft left frame 30 and the soft right frame 31 and around the lenses 32. Through holes 331 are defined in the flanges 33 and corresponding to the assembling holes 24 of the first assembling frame 20 and the second assembling frame 21. Ribs 34 are respectively formed on the flanges 33 of the soft left frame 30 and the soft right frame 31 for latching the positioning holes 221 of the clamp portions 22 thereby positioning the soft left frame 30 and the soft right frame 31. Positioning grooves 36 are respectively defined in the flanges 33 of the soft left frame 30 and the soft right frame 31 and correspond to the clamp arms 23 of the first assembling frame 20 and the second assembling frame 21 for retaining the clamp arms 23. When assembled, the soft left frame 30 and the soft right frame 31 are respectively assembled from the clamp portions 22. The ribs 34 latch the positioning holes 221 of the clamp portions 22. The flanges 33 of the soft left frame 30 and the soft right frame 31 are fixed with first parts. The clamp arms 23 latch with the positioning grooves 35. The clamp arms 23 latch second parts of the flanges 33 of the soft left frame 30 and the soft right frame 31. The expanding screws 25 extend through the assembling holes 24, the through holes 331 and lock holes 410 of the hard buckles 4 to fix the soft left frame 30 and the soft right frame 31. Thus, the soft left frame 30 and the soft right frame 31 are assembled on the first assembling frame 20 and the second assembling frame 21.

The hard buckles 4 are made of Nylon, and are assembled on the first assembling frame 20 and the second assembling frame 21, respectively. Each hard buckle 4 defines a strap slot 40 in one side for accommodating a head strap (not shown), and forms a connecting bridge 41 on another side thereof. The connecting bridges 41 of the hard buckles 4 are assembled below the through holes 331 of the soft left frame 30 and the soft right frame 31 when assembled. Each connecting bridge 41 defines a lock hole 410 therein corresponding to the through holes 331 for receiving and positioning the expanded screw 25. A link arm 42 is formed adjacent to the lock hole 410 for enhancing the hard buckle 4. Each hard buckle 4 further forms an axis base 43 and an embedding groove 44 for assembling with the strap adjusting element 6.

The strap adjusting elements 6 are made of the same material as the hard buckles 4, and are pivoted to the strap slots 40 of the hard buckles 4. Each strap adjusting element 6 forms an abut arm 60 near the strap slot 40 for controlling abutment of the head strap (not shown). Each strap adjusting element 6 further forms a support arm 61 opposite to the abut arm 60 for abutting the link arm 42 when the strap adjusting element 6 is assembled to the hard buckle 4, thereby providing appropriate return resiliency of the strap adjusting element 6 when the strap adjusting element 6 disengages from the head strap. Each strap adjusting element 6 forms a pivot shaft 62 and a latch arm 63 respectively for engaging with the shaft base 43 and the embedding grooves 44 of the hard buckle 4.

Figure 3:
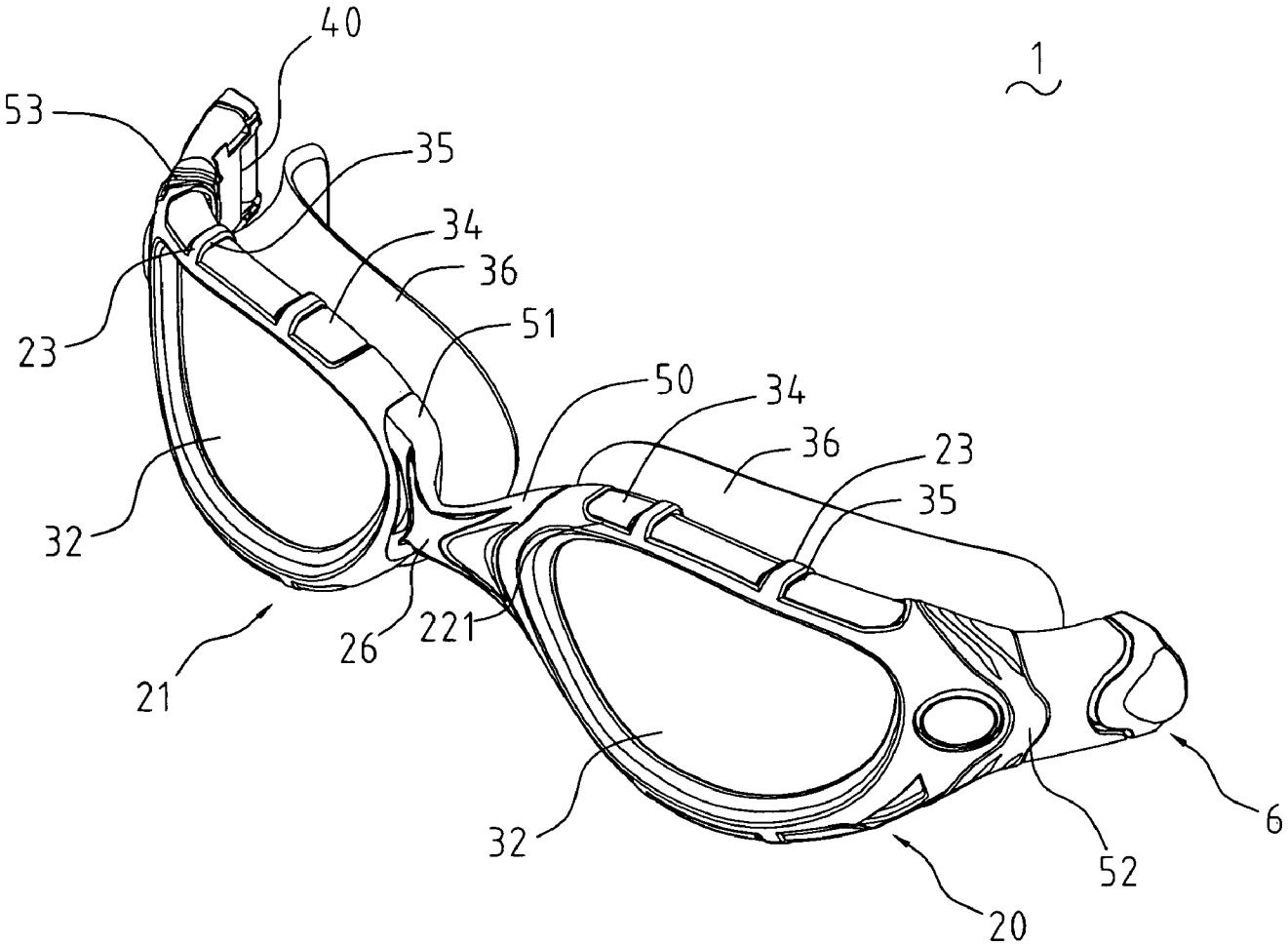
FIG. 3 is an assembled view of the swimming goggles of FIG. 1.
Figure 4:
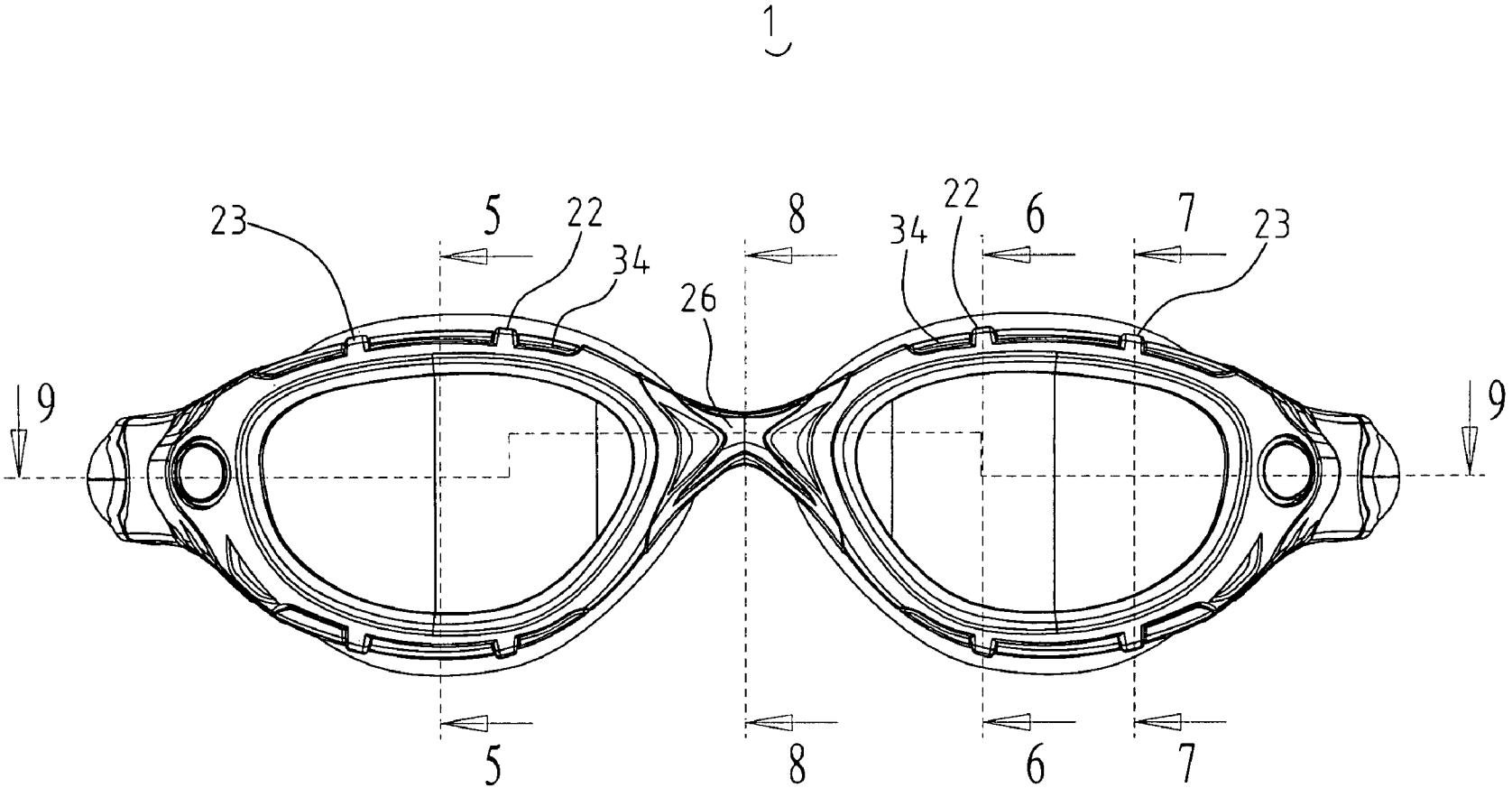
FIG. 4 is a front view of FIG. 3.
Figure 7:
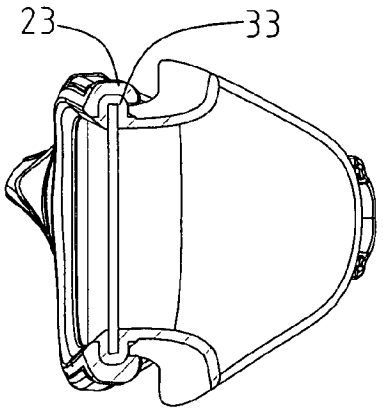
FIG. 7 is a cross-sectional view taken along the line 7-7 in FIG. 4.
Figure 8:
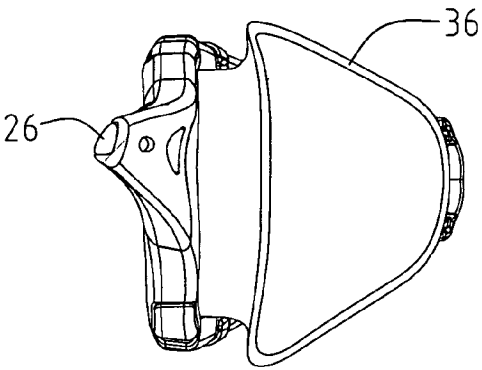
FIG. 8 is a cross-sectional view taken along the line 8-8 in FIG. 4.
Figure 5:
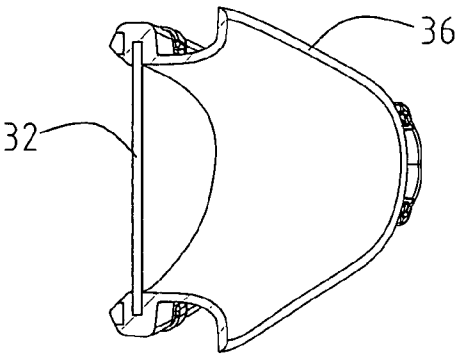
FIG. 5 is a cross-sectional view taken along the line 5-5 in FIG. 4.
Figure 6:
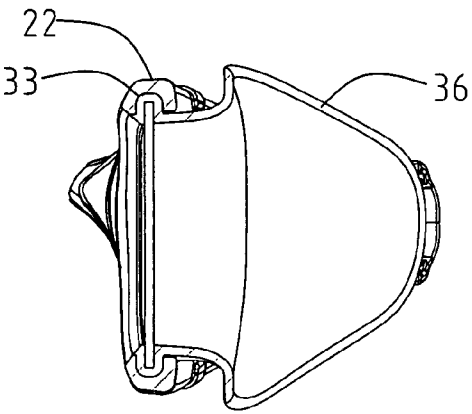
FIG. 6 is a cross-sectional view taken along the line 6-6 in FIG. 4.
Figure 9:
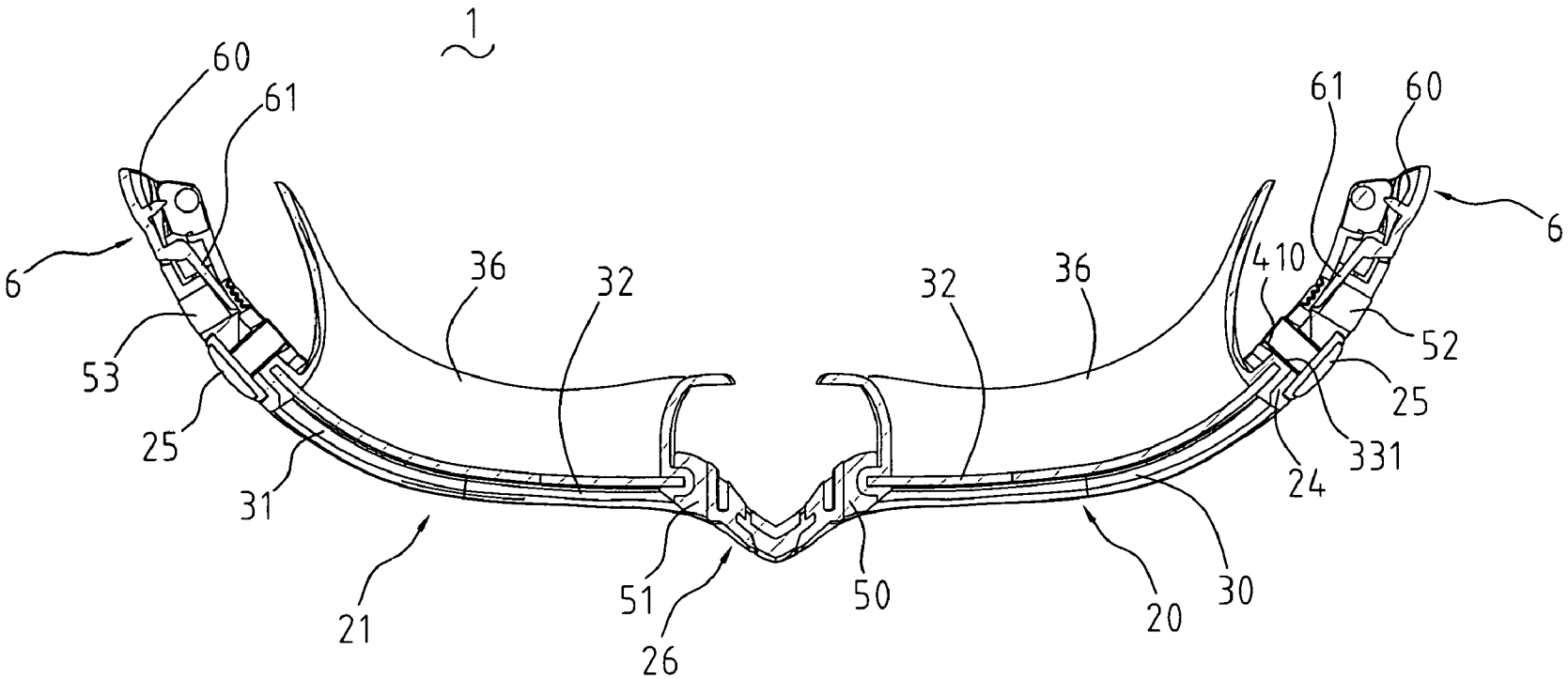
FIG. 9 is a cross-sectional view taken along the line 9-9 in FIG. 4.

With reference to FIGS. 1 through 9, the soft left frame 30 and the soft right frame 31 are assembled from the clamp portions 22. As shown in FIGS. 3 and 5, the ribs 34 latch the positioning holes 221 of the clamp portions 22, whereby first parts of the flanges 33 of the soft left frame 30 and the soft right frame 31 are fixed. The clamp arms 23 latch the positioning grooves 35 (see FIG. 6), whereby second parts of the flanges 33 of the soft left frame 30 and the soft right frame 31 are fixed (see FIGS. 3 and 7). The expanded screws 25 extend through the assembling holes 24, the through holes 331 and the lock holes 410 (see FIG. 9), whereby the clamp portions 22, the clamp arms 23 and the expanded screws 25 of the first assembling frame 20 and the second assembling frame 21 retain the soft left frame 30 and the soft right frame 31 by means of three sections.

The swimming goggles 1 of the present invention comprise the first joint portion 50, the second joint portion 51, the third joint portion 52 and the fourth joint portion 53. The first joint portion 50 and the second joint portion 51 provide bendable flexibility for the connecting member 26. The third joint portion 52 and the fourth joint portion 53 provide bendable flexibility for side edges of the first assembling frame 20 and the second assembling frame 21. The connecting member 26 touches users' nose profiles fitly owing to the bendable flexibility. The first assembling frame 20 and the second assembling frame 21 fit to users' face profiles owing to the bendable flexibility. Users with different nose and face profiles wear the swimming goggles of the present invention ergonomically and comfortably without water leakage.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. Swimming goggles comprising:

a hard combined frame including a first assembling frame, a second assembling frame, and a connecting member connecting the first assembling frame with the second assembling frame, the first assembling frame defining a first opening, and the second assembling frame defining a second opening;

a soft left frame and a soft right frame respectively assembled in the first opening and the second opening, the soft left frame and the soft right frame respectively receiving lenses therein and being formed with pads; and hard buckles respectively assembled on the first assembling frame and the second assembling frame, each hard buckle defining a strap slot therein for accommodating a head strap;

wherein the connecting member has first means with bendable flexibility for fitting to users' nose profiles, the first means comprises a first joint portion and a second joint portion which are located on both sides of the connecting member, and the first assembling frame and the second assembling frame have second means with bendable flexibility on at least parts of side edges thereof for fitting to users' face profiles, the second means comprises a third joint portion and a fourth joint portion which are located on parts of side edges of the first and second assembling frames, and the first, second, third and fourth joint portions are made of soft material for providing bendable flexibility, whereby users with different nose and face profiles wear the swimming goggles ergonomically and comfortably without water leakage.

2. The swimming goggles as claimed in claim 1, wherein the first joint portion, the second joint portion, the third joint portion and the fourth joint portion are made of Thermoplastic Rubber (TPR).

3. The swimming goggles as claimed in claim 1, wherein the hard combined frame is made of Polypropylene (PP), the soft left frame and the soft right frame are made of Silicon Rubber, and the hard buckles are made of Nylon.

4. Swimming goggles comprising:

a hard combined frame including a first assembling frame, a second assembling frame, and a connecting member connecting the first assembling frame with the second assembling frame, the first assembling frame defining a first opening, and the second assembling frame defining a second opening;

a soft left frame and a soft right frame respectively assembled in the first and second openings, the soft left and right frames respectively receiving lenses therein and being formed with pads; and hard buckles respectively assembled on the first and second assembling frames, each hard buckle defining a strap slot therein for accommodating a head strap;

wherein the connecting member has first means with bendable flexibility for fitting to users' nose profiles, the first assembling frame and the second assembling frame having second means with bendable flexibility on at least parts of side edges thereof for fitting to users' face profiles, whereby users with different nose and face profiles wear the swimming goggles ergonomically and comfortably without water leakage; and wherein the first assembling frame and the second assembling frame retain the soft left frame and the soft right frame by means of three sections, arcuate clamp portions are respectively formed on the first and second assembling frames and near the connecting member in assembly, clamp arms being respectively formed on the first and second assembling frames and adjacent to the clamp portions, assembling holes and expanding screws being respectively provided in the first and second assembling frames and corresponding to sides of the connecting member, flanges being formed on the soft left and right frames and around the lenses, positioning grooves being formed on the flanges, through holes being defined in the soft left and right frames, and corresponding to the assembling holes of the first and second assembling frames, in assembly, the soft left and right frames being assembled with the clamp portions, the clamp arms being latched with the positioning grooves to fix the flanges, the expanding screws extending through the assembling holes and the through holes to fix the soft left and right frames, whereby the first assembling frame and the second assembling frame retain the soft left frame and the soft right frame.

5. The swimming goggles as claimed in claim 4, wherein each clamp portion defines at least a positioning hole, and the flanges of the soft left frame and the soft right frame form ribs thereon for latching the positioning holes of the clamp portions.

6. The swimming goggles as claimed in claim 4, wherein each hard buckle forms a connecting bridge below the through hole of the soft left frame and the soft right frame when assembled, the connecting bridge defining a lock hole therein corresponding to the through hole for receiving and positioning the expanded screw.

7. The swimming goggles as claimed in claim 6, wherein a link arm is formed adjacent to the lock hole of the connecting bridge.

8. The swimming goggles as claimed in claim 7, further comprising strap adjusting elements respectively pivoted to the strap slots of the buckles, each strap adjusting element forming an abut arm near the strap slot for controlling abutment of the head strap.

9. The swimming goggles as claimed in claim 8, wherein each strap adjusting element further forms a support arm opposite to the abut arm for abutting the link arm when the strap adjusting element is assembled to the hard buckle, and providing appropriate return resiliency of the strap adjusting element when the strap adjusting element disengages from the head strap.

10. The swimming goggles as claimed in claim 8, wherein each hard buckle has a shaft base and embedding grooves, and each strap adjusting element forms a pivot shaft and a latch arm respectively for engaging with the shaft base and the embedding grooves of the hard buckle.

* * * * *